US005926138A

United States Patent [19]

Eerikäinen

[11] Patent Number: 5,926,138

[45] **Date of Patent: *Jul. 20, 1999**

[54] ANTENNA CONNECTION

[75] Inventor: Jukka Eerikäinen, Tampere, Finland

[73] Assignee: Nokia Mobile Phones, Ltd., Salo, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/733,100

[22] Filed: Oct. 16, 1996

[30] Foreign Application Priority Data

Oct. 27, 1995 [FI] Finland ..... 955125

[51] Int. Cl.[6] ..... H01Q 1/24; H01Q 1/50

[52] U.S. Cl. ..... 343/702; 343/906

[58] Field of Search ..... 343/702, 906, 343/715, 900, 901; H01Q 1/24, 1/50

[56] References Cited

U.S. PATENT DOCUMENTS

| | | | |
|---|---|---|---|
| 4,024,542 | 5/1977 | Ikawa et al. | 343/702 |
| 4,350,408 | 9/1982 | Hays | 339/149 S |
| 4,882,591 | 11/1989 | Galvin et al. | 343/715 |
| 4,998,078 | 3/1991 | Hulkko | 333/109 |
| 5,218,370 | 6/1993 | Blaese | 343/702 |
| 5,229,784 | 7/1993 | Jones | 343/888 |
| 5,276,920 | 1/1994 | Kuisma | 455/101 |
| 5,278,570 | 1/1994 | Jaramillo et al. | 343/702 |
| 5,336,896 | 8/1994 | Katz | 250/515.1 |
| 5,341,149 | 8/1994 | Valimaa et al. | 343/895 |
| 5,422,651 | 6/1995 | Chang | 343/702 |

FOREIGN PATENT DOCUMENTS

| | | | |
|---|---|---|---|
| 0601702 A1 | 6/1994 | European Pat. Off. . | |
| 39 12034 C1 | 10/1990 | Germany . | |
| 42 30 518 AI | 3/1994 | Germany . | |
| 43 28 061 A1 | 2/1995 | Germany . | |
| 55-147806 | 11/1980 | Japan | 343/702 |
| 2 192 757 | 1/1988 | United Kingdom . | |
| 2195841 | 4/1988 | United Kingdom . | |

OTHER PUBLICATIONS

Patent Abstracts of Japan, vol. 13, No. 496, 9 Nov. 1989 & JP–A–01 200703, (Fujitsu) 11 Aug. 1989.

Abstract ad Patent Journal of Republic of South Africa, vol. 20, No. 8, 26 Aug. 1987, ZA 86/9164, 8 Jun. 1987, abstract.

*Primary Examiner*—Hoanganh Le

*Attorney, Agent, or Firm*—Perman & Green, LLP

[57] ABSTRACT

The object of the invention is a radio set comprising a chuck for attaching an antenna unit to the device. The chuck (1) comprises a device (5) for a quick attachment of the antenna unit (2, 3) to the chuck. Furthermore, the device comprises a connection (7) for establishing an electric contact from the antenna unit attached to the chuck to the transceiver through the chuck. The connection according to the invention is quick with respect to the assembly. Furthermore, the connection does not wear adversely when the antenna is rotated.

8 Claims, 3 Drawing Sheets

ANTENNA CONNECTION

BACKGROUND

Figure 1:
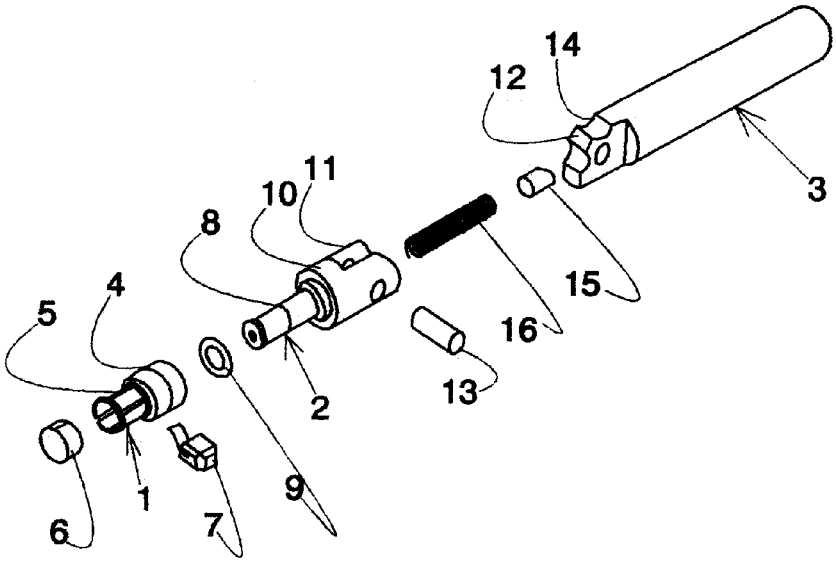

The invention is related to radio equipment technology and is particularly concerned with connecting an antenna to a radio set with the aid of a chuck. The invention is particularly well-adapted to be used in relatively small telecommunication devices which require an antenna that is both rotatable and turnable. The invention can be applied in mobile phones, for example.

Generally, mobile phones employ antennas that can be pushed inside the device to save space. Such an antenna is not the best possible solution for all devices, which is why antennas are required which are outside the device in full.

It is well-known to attach an external antenna to a device by using a chuck to which the antenna is attached by threads. One problem of the solution is that it slows down the assembly of the device.

Another solution is known in which the antenna can be attached to the chuck by pushing it into the chuck and detached by pulling it out of it (Ericsson mobile phone GH 337). In this solution, an electric contact is established directly from the end of the shaft journal to the circuit card. In principle, the antenna is rotatable but if this is done repeatedly in daily usage, the tip of the shaft journal will wear down fairly quickly. Consequently, the antenna element is provided with a special plastic snap ring which is intended to prevent unnecessary rotation of the antenna.

DESCRIPTION OF THE INVENTION

A radio set according to Claim 1 provided with an antenna connection has now been invented. The preferred embodiments of the invention are presented in the other Claims.

According to the invention, the antenna unit can be attached to the device by a quick-fastening and the electric connection from the antenna to the transceiver means is provided through the chuck. Because of the quick-fastening, the antenna is fast to install in production. Furthermore, the antenna is easy to attach in use when desired. When the contact is established through the chuck, there will be less wear.

The chuck can be constructed so that the antenna unit can be detached from it quickly.

The chuck can be constructed so that the antenna can be rotated on it. In this way, it is easy to turn the antenna in an optimal position without having to move the device itself. Such an antenna is especially advantageous in a multipurpose data transmission device which can be used to transmit both audio information and alphanumeric or visual information. Furthermore, the antenna is preferably articulated so that it is possible to choose different operational angles to achieve optimal transmission and reception performance in different operating environments.

The chuck and the end of the antenna unit attached thereto can constitute a combination of a sleeve and a pin. The chuck may constitute the sleeve and the end of the antenna unit can constitute the pin placed in it. The chuck may be constructed so that the antenna unit can be attached to it by pushing and detached from it by pulling.

The chuck may comprise a flexible fastening member so that the end of the antenna unit can be attached to the chuck against the spring force. In this case, the flexible fastening member itself may be flexible, or the end of the antenna unit may be provided with a flexible fitting member that corresponds to the flexible fastening member. The flexible fastening member may be provided with a separate spring.

The chuck may be attached to the case of the device or, for example, directly to the circuit board.

To provide the electric connection from the chuck to the circuit of the device, a suitable contact member such as a spring can be provided. The contact point between the chuck and the circuit can be stationary, even if the antenna is rotated in the chuck. In this way, wear-and-tear can be eliminated.

The antenna unit may be provided with a special attachment which is used to attach the unit to the chuck. Preferably, the antenna is rotatable in the transverse direction of the axis in the attachment and the unit is provided with locking members to lock the swing angle of the antenna.

Another object of the invention is an antenna unit suitable for the device according to Claim 1.

Figure 2:
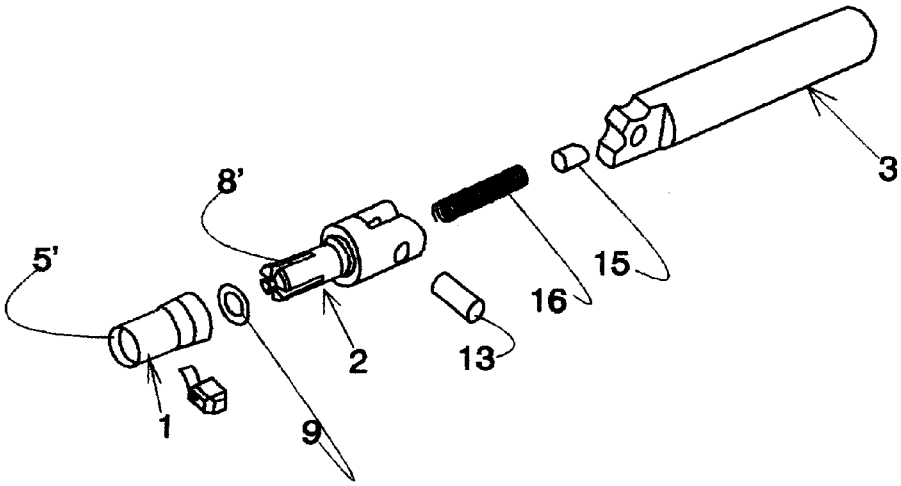
Figure 3:
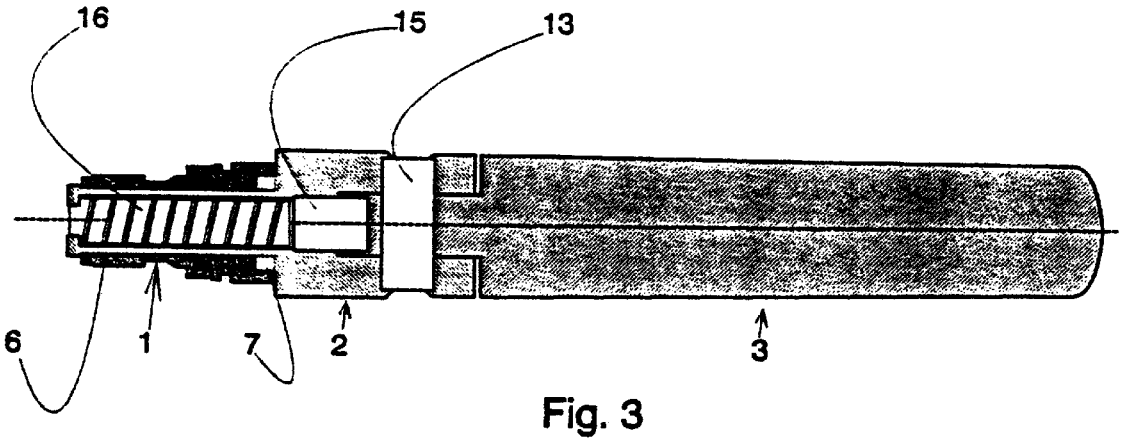
Figure 4:
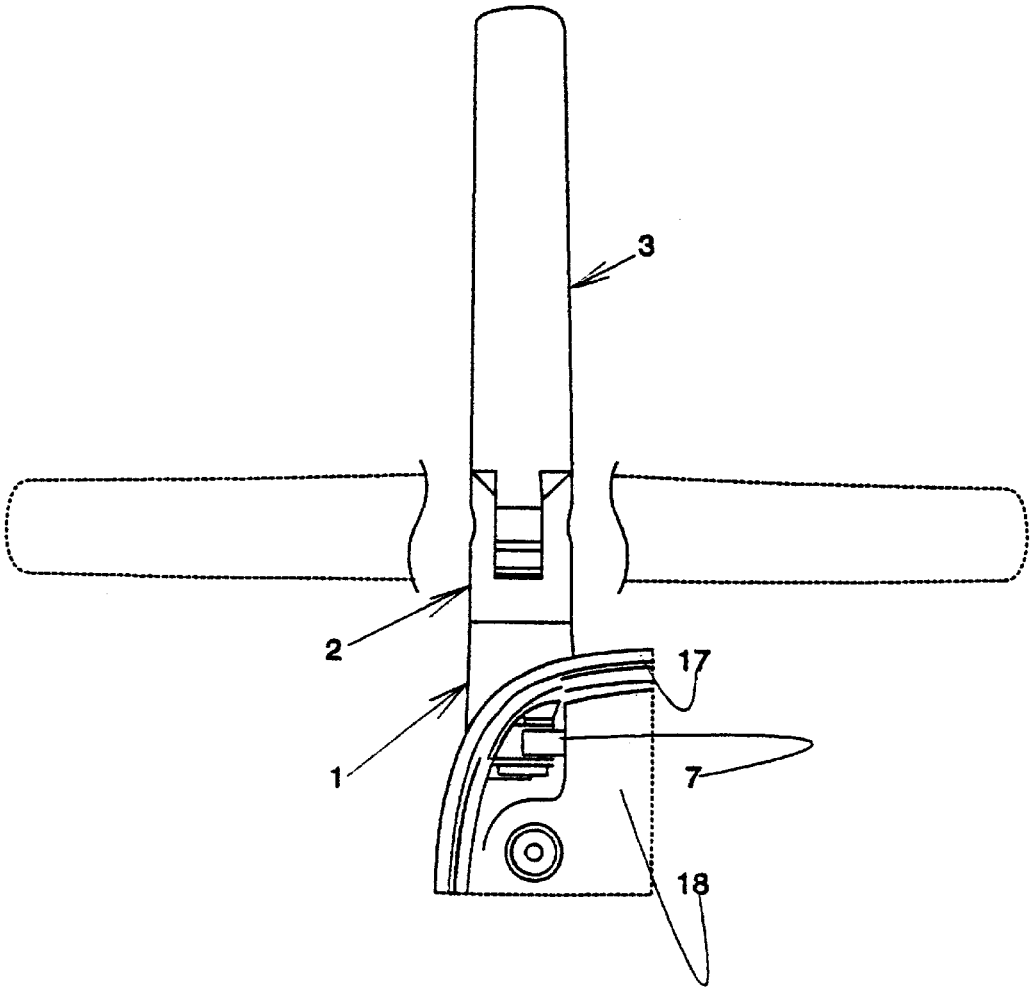
Figure 5:
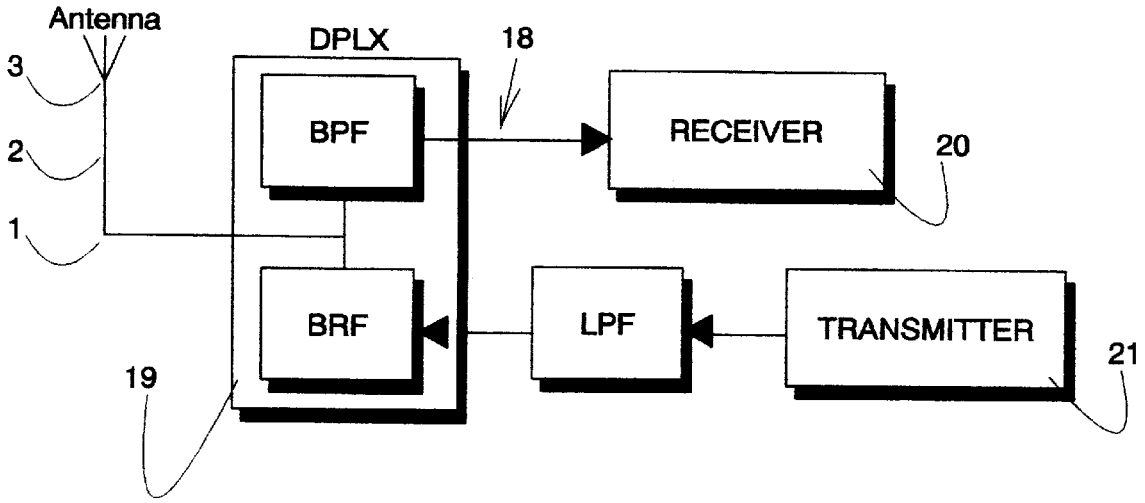

In the following, some advantageous applications of the invention are described in detail. The appended drawings are part of the description of the invention. In the drawings FIG. 1 is an exploded view of a chuck and an antenna unit according to the invention, FIG. 2 presents an alternative embodiment of the structure of FIG. 1, FIG. 3 presents the structure of FIG. 1 in the assembled form, FIG. 4 presents the structure of FIG. 1 in a mobile phone, and FIG. 5 presents the functional diagram of the radio set.

The main parts of the antenna connection according to FIG. 1 comprise chuck 1, fastening sleeve 2 of the antenna, and antenna 3.

Chuck 1 is a sleeve-like body with a support flange 4 provided at the upper end and a tensioning recess 5 flexible in the radial direction and narrower than the support flange provided at the lower end thereof. The flexibility of the recess is provided by axial cuts on the lower end of the flange. An annular spring groove is provided on the outer surface of the recess and annular leaf spring 6 is placed in the groove. The leaf spring tends to prevent the expansion of the tensioning skirt in the radial direction. The electric contact is established from the chuck, the side thereof, to the circuit of the device by spring clip 7 which presses against the leaf spring. The chuck is attached to the outer case of the device at its support flange so that the upper end of the flange is placed outside the case.

Rotary pin 8 that is fitted in chuck 1 is provided at the lower end of fastening sleeve 2 of the antenna, the lower end of the rotary pin being provided with a locking flange. When the pin is pushed into the chuck, the strips of its recess 5 bend elastically outwards until the locking flange of the pin has passed through the skirt of the recess, whereby the pin is locked in place. However, the pin can be rotated in the chuck. To ensure even rotation, O ring 9 is placed between the chuck and the sleeve to provide convenient and even rotational friction. The locking flange of the pin and the lower end of the recess are suitably chamfered so that the pin can be pulled out of the chuck against the force of the strips of the recess and that of spring 6.

Swivel base 10 of the antenna is provided at the upper end of fastening sleeve 2. It is provided, at the upper end thereof, with groove 11 in the axial direction and with a bore lateral to the groove. Correspondingly, the lower end of antenna 3 is provided with base block 12 of the same width as the groove and provided with a bore. The base block of the antenna is placed in the groove and attached in place by using fastening pin 13 that is pushed through the bores.

The groove of swivel base 10 and base block 12 of the antenna are so designed that the antenna can be turned in the groove. In this way, the antenna can be placed in the best possible angle with respect to reception or transmission. However, the antenna is easy to place in and to detach from the device.

Fastening sleeve 2 and base block 12 of the antenna are further provided with a rotatable locking system which can be used to lock the antenna at a given switch angle. For this purpose, transversal slits 14 are provided on the surface of the base block and slide 15 and spring 16 are provided in the fastening sleeve, the spring pressing the slide against the base block. The slits and the slide are so designed that the antenna can be turned against the spring force, whereby the slide moves from one slit to another. In the application according to the figures, two slits are provided so that the antenna can be locked accurately either at a 0° or a 90° angle. Naturally, other locking angles and a larger number of them may be used when desired. Because the sleeve can be turned in the chuck,it is sufficient that locking slits are provided only on one side of the fastening block.

Spring 16 not only locks antenna 3 but also ensures the contact between sleeve 2, pin 13, and the antenna.

Spring 16 is a helical spring in this embodiment. Slide 15 is a pin which is pressed by the spring, at the lower end thereof, against the fastening block. Fastening sleeve 2 is provided with a recess extending from upwards to rotary pin 8, the lower end of the spring pressing the bottom of the recess.

Chuck 1 and fastening sleeve 2 consist of, e.g., brass, and fastening pin 13 of steel. Leaf spring 6 is of, e.g., stainless steel, and slide 15 of a suitable plastic. Antenna 3 consists of a desired metal.

Depending on the use, the frequency range of the antenna can range between 450 kHz and 2 GHz, for example. Matching impedance can range between 20 and 200 Ω and it can be either inductive or capacitive.

FIG. 2 presents an application corresponding to FIG. 1, comprising chuck 1 that is provided with stiff recess 5', but the surface of the rotary pin 8' of fastening sleeve 2 is flexible in the radial direction. In this case, there is no need for a separate check spring to lock the fastening sleeve to the chuck. Otherwise, the device is similar to that in FIG. 1. Spring clip 7 is directly against the chuck in this application.

FIG. 3 presents the application according to FIG. 1 in an assembled form and with antenna 3 in a straight position.

FIG. 4 presents antenna 3 installed in a mobile phone. Chuck 1 is attached to case 17. Spring clip 7 is soldered to circuit board 18.

FIG. 5 presents the functional diagram of the mobile phone. Antenna unit 3, 2 is attached to the device with the aid of chuck 1. The antenna is in contact with duplex filter 19 which is connected to receiver 20 and transmitter 21.

Regarding the assembly of the device, the solution is easy and quick. Chuck 1 can be installed in the case during manufacture. Antenna 3 can also be attached to its sleeve 2 in advance. The only thing that is required when assembling the actual device is to push the antenna unit in place. The antenna requires neither tensioning by twisting nor installing connectors to establish connection from the cable to the antenna. Furthermore, the user will be able to easily relocate the antenna unit. Consequently, it can be placed separately in the package of the device to save space. The user may also easily detach the antenna unit for transportation or replacement, for example.

Furthermore, antenna connection 1, 2 withstands repeated twisting well, which is advantageous in devices in which antenna 3 must be adjusted frequently to ensure the best possible transmission and reception performance. This might be the case in dual-purpose data transmission devices in particular which can be used to transmit both audio and alphanumeric or visual information. In this case, the device can be in a stationary position on the base and an optimal position of the antenna can be obtained by only moving the antenna. Furthermore, the articulation of the antenna allows for a considerably larger variety of positions.

A large contact surface is provided between fastening sleeve 2 and chuck 1, whereby wear-and-tear will not be a problem (as opposed to, for example, a device in which the thin end of an antenna pin is against the contact body). In the device described, the chuck and contact member 7 do not move with respect to one another at all when the antenna is turned in the chuck.

The entire recess 5/5' does not have to be made of conductive material but one side of the periphery can comprise plastic and the other side metal so that contact member 7 is naturally in contact with the metal. One possibility is to only make the surface of the recess conductive.

Furthermore, when spring 6 is connected to flexible recess 5, on which spring the stress is mainly exerted, even a plastic recess will withstand a fairly large amount of deflection without wearing out. If the spring fatigues, it can be replaced.

I claim:

1. A radio set comprising a circuit (18) including a transceiver means, and a chuck for attaching an antenna unit to the set, characterized in that the chuck (1) comprises means (5;5') for a quick fastening of the antenna unit to the chuck and enables a quick detachment of the antenna unit attached to the chuck, and that the set comprises means (1,7) for establishing an electric contact from the antenna unit attached to the chuck to the circuit (18) through the chuck, and wherein said chuck further includes a locking means (5;5') for which the antenna unit is positively locked to said chuck by nonrotatably axially pushing and is detached by nonrotatably axially pulling said antenna unit from said chuck.

2. The radio set according to claim 1, characterised in that the chuck comprises a means (5; 5') which allows the antenna unit attached to the chuck to be rotated around its axis.

3. The radio set according claim 1, characterised in that the chuck comprises an adapter (5; 5') which, together with the end of the antenna unit attached to the chuck, forms a nesting sleeve and pin combination, so that the chuck constitutes the sleeve and the end of the antenna unit constitutes the pin.

4. The radio set according to claim 1, characterised in that the chuck comprises a flexible fastening member (5; 5') and the antenna unit is attached to the chuck against the force of the flexible fastening member.

5. The radio set according to claim 1, characterized in that the device comprises a spring contact member to establish an electric contact from the chuck to the circuit of the radio set.

6. An antenna unit to be attached to a radio set comprising a circuit that includes a transceiver means, and a chuck for the antenna unit, characterized in that the antenna unit comprises an adapter (2) which can be used for a quick attachment of the antenna unit to the chuck (1) and that the adapter comprises a member (8;8') for establishing an electric contact through the chuck to the circuit; and wherein said chuck (1) comprises means (5;5') for a quick fastening of the antenna unit to the chuck and enables a quick detachment of the antenna unit attached to the chuck, and a locking means (5;5') for which the antenna unit is positively locked to said chuck by nonrotatably axially pushing and is detached by nonrotatably axially pulling said antenna unit from said chuck.

7. A mobile phone set comprising:

a chuck having a flexible fastening member (5, 8; 5', 8');

an antenna unit comprising a rotary pin (8; 8') to be fitted in the chuck;

the chuck being provided with a tensioning recess (5) flexible in the radial direction; and the rotary pin having a lower end provided with a locking flange which when inserted into said tensioning recess positively locks therewith.

8. A mobile phone set comprising:

a chuck having a flexible fastening member (5, 8; 5', 8');

an antenna unit comprising a rotary pin (8; 8') to be fitted in the chuck;

the chuck being provided with a stiff recess (5') and said rotary pin (8') being flexible in the radial direction; and the rotary pin having a lower end provided with a locking flange which when inserted into said stiff recess positively locks therewith.

* * * * *